US010028557B1

(12) United States Patent
Chen et al.

(10) Patent No.: US 10,028,557 B1
(45) Date of Patent: Jul. 24, 2018

(54) AUTOMATIC REVERSE MULTI-FOLDING UMBRELLA

(71) Applicant: XIAMEN MINGHO BROTHERS MFG CO., LTD., Xiamen (CN)

(72) Inventors: Tien Cheng Chen, Xiamen (CN); Sun Feng Sung, Xiamen (CN)

(73) Assignee: XIAMEN MINGHO BROTHERS MFG CO., LTD., Xiamen, Fujian (CN)

( * ) Notice: Subject to any disclaimer, the term of this patent is extended or adjusted under 35 U.S.C. 154(b) by 0 days.

(21) Appl. No.: 15/481,484

(22) Filed: Apr. 7, 2017

(30) Foreign Application Priority Data

Jan. 9, 2017 (CN) ..... 2017 2 0021350 U

(51) Int. Cl.

| | |
|---|---|
| ***A45B 25/14*** | (2006.01) |
| ***A45B 19/00*** | (2006.01) |
| ***A45B 19/04*** | (2006.01) |
| ***A45B 25/02*** | (2006.01) |

(52) U.S. Cl.
CPC ..... *A45B 25/143* (2013.01); *A45B 19/04* (2013.01); *A45B 25/02* (2013.01); *A45B 2019/008* (2013.01)

(58) Field of Classification Search
CPC ..... A45B 25/143; A45B 2019/008
See application file for complete search history.

(56) References Cited

U.S. PATENT DOCUMENTS

| | | | | |
|---|---|---|---|---|
| 7,909,049 | B2 * | 3/2011 | Yang | A45B 19/04 135/20.3 |
| 8,151,811 | B2 * | 4/2012 | Chong | A45B 25/143 135/20.3 |
| 8,286,650 | B2 * | 10/2012 | Chong | A45B 25/143 135/22 |
| 8,757,184 | B1 * | 6/2014 | Chen | A45B 19/04 135/20.3 |
| 9,282,793 | B2 * | 3/2016 | Chen | A45B 25/143 |
| 9,364,058 | B1 * | 6/2016 | Hsieh | A45B 9/00 |
| 9,526,307 | B1 * | 12/2016 | Hsieh | A45B 25/006 |
| 9,591,903 | B1 * | 3/2017 | Hsieh | A45B 25/143 |
| 2017/0099919 | A1 * | 4/2017 | Mullet | A45B 25/143 |

FOREIGN PATENT DOCUMENTS

| | | | | |
|---|---|---|---|---|
| GB | 2529176 A | * | 2/2016 | A45B 19/04 |

* cited by examiner

*Primary Examiner* — Noah Chandler Hawk
(74) *Attorney, Agent, or Firm* — Leong C. Lei

(57) ABSTRACT

An automatic reverse multi-folding umbrella includes a frame, an umbrella cloth secured on the frame, a middle rod set, an upper nest fixed to an upper end of the middle rod set, a lower nest fitted on the middle rod set, a handle, an umbrella opening/closing control system disposed in the middle rod set, and an umbrella opening/closing operating system disposed in the handle and the middle rod set. The umbrella can be folded and unfolded automatically. After the umbrella is folded, the umbrella cloth is folded reversely and the outer surface of the umbrella cloth is folded inside the umbrella, such that the umbrella can be used more conveniently, comfortably and quickly.

9 Claims, 8 Drawing Sheets b-b c-c d-d

AUTOMATIC REVERSE MULTI-FOLDING UMBRELLA

FIELD OF THE INVENTION

The present invention relates to an umbrella, and more particularly to an automatic reverse multi-folding umbrella.

BACKGROUND OF THE INVENTION

An umbrella is an essential necessity in daily life for shading people from the sun or rain. When it rains, an umbrella plays an indispensable role. A folding umbrella is easy to carry and popular because of its small size after folded.

Therefore, an improved automatic multi-folding umbrella is developed. The umbrella handle is provided with a button. The user just presses the button to unfold the umbrella automatically. But, this kind of umbrella doesn't have the function to fold the umbrella automatically. When the user gets in the car, he/she has to fold the umbrella with both hands. In this short period of time, the user may be wetted by rain. This umbrella is inconvenient for use.

Chinese Utility Model Publication No. CN2476208Y published on Feb. 13, 2002 discloses a control device for an automatic umbrella. The working principle of this umbrella is that when the umbrella is unfolded, the button is pressed and the control device releases the middle rod of the umbrella. The middle rod is biased by the springs inside the middle rod to extend upward so as to unfold the umbrella. When the user wants to fold the umbrella, the button is pressed again for the control device to release the buckle inside the middle rod. The springs on the frame urges the umbrella to be folded. The buckle is pulled by the pull rope to the top of the middle rod. At this moment, the umbrella is not fully folded. The user has to push a portion of the umbrella toward the handle to shorten the middle rod. The springs are restored to energize, and the middle rod and the buckle are controlled by the control device in the handle again. Thus, the umbrella is folded completely.

For this type of folding umbrella, a part of the outer surface of the umbrella cloth faces outward after folded. On a rainy day, the user may get contact with the outer surface of the umbrella cloth after the multi-folding umbrella is folded. As a result, the user's clothes may be wetted by rain.

Accordingly, the inventor of the present invention has devoted himself based on his many years of practical experiences to solve these problems.

SUMMARY OF THE INVENTION

In view of the shortcomings of the prior art, the primary object of the present invention is to provide an automatic reverse multi-folding umbrella which can be unfolded/folded fully. After the umbrella is folded, the umbrella cloth is folded reversely so that the outer surface is not exposed.

In order to achieve the aforesaid object, the automatic reverse multi-folding umbrella of the present invention comprises a frame, an umbrella cloth secured on the frame, a middle rod set, an upper nest fixed to an upper end of the middle rod set, a lower nest fitted on the middle rod set, a handle, an umbrella opening/closing control system disposed in the middle rod set, and an umbrella opening/closing operating system disposed in the handle and the middle rod set. The frame includes a main rib and a sub-rib. The main rib includes an inner rib, an intermediate rib, an outer rib, an intermediate rib return line, an outer rib return line, and a spring. One end of the sub-rib is pivotally connected to the upper nest, and another end of the sub-rib is pivotally connected to the inner rib. An inner end of the inner rib is pivotally connected to the lower nest, and an outer end of the inner rib is pivotally connected to the intermediate rib through a first pivot joint. An outer end of the intermediate rib is pivotally connected to the outer rib through a second pivot joint. An outer end of the outer rib is connected to an outer edge of the umbrella cloth through a bead. An inner edge of the umbrella cloth is secured on the upper nest. One end of the intermediate rib return line is pivotally connected to the sub-rib, and another end of the intermediate rib return line is pivotally connected to the first pivot joint on a joint of the intermediate rib. One end of the spring is connected to the sub-rib, and another end of the spring is connected to the first pivot joint. One end of the outer rib return line is pivotally connected to the first pivot joint, and another end of the outer rib return line is pivotally connected to the outer rib. The middle rod set has at least three sleeves, including an outer sleeve, a middle sleeve and an inner sleeve arranged from top to bottom in sequence. An upper end of the outer sleeve is provided with an outer sleeve pulley, and a lower end of the outer sleeve is connected with an outer sleeve fixing ring cooperating with the middle sleeve. An upper end of the middle sleeve is provided with a middle sleeve plug having a middle sleeve pulley, and a lower end of the middle sleeve is connected with a middle sleeve fixing ring. An outer side of the middle sleeve fixing ring is provided with a middle sleeve fixing ring pulley. A lower end of the inner sleeve is fixed to the handle. The umbrella opening/closing control system includes a lower nest pull rope, a transformation ratio pull rope, and an inner sleeve pull rope. One end of the lower nest pull rope is fixed to the middle sleeve plug, and another end of the lower nest pull rope is inserted through the outer sleeve and wound on the outer sleeve pulley to be fixed to the lower nest. One end of the transformation ratio pull rope is fixed to the upper end of the inner sleeve, and another end of the transformation ratio pull rope is inserted through the bottom of the middle sleeve and wound on the middle sleeve fixing ring pulley of the middle sleeve fixing ring and inserted through the middle sleeve to extend out of the upper end of the middle sleeve and inserted through the outer sleeve to extend out of the upper end of the outer sleeve to be fixed to the top of the outer sleeve. One end of the inner sleeve pull rope is fixed to the upper end of the inner sleeve, and another end of the inner sleeve pull rope is inserted through the middle sleeve and wound on the middle sleeve pulley of the middle sleeve plug and inserted between the middle sleeve and the outer sleeve to be fixed to the lower end of the outer sleeve. The umbrella opening/closing operating system includes a screw rod, a nut mated on the screw rod, a push rod connected with the nut, and a power source to drive the screw rod. Another end of the push rod is connected to the middle sleeve plug. The power source is controlled by a button on the handle.

Preferably, an outer sleeve plug is provided and fixed in the upper end of the outer sleeve. The outer sleeve plug has a central through hole. The outer sleeve pulley is disposed at an upper portion of the outer sleeve plug. The outer sleeve is formed with a notch corresponding in position to the outer sleeve pulley.

Preferably, an inner sleeve plug is provided and fixed to an upper end of the inner sleeve. The inner sleeve is radially provided with a positioning device for preventing the middle sleeve from sliding down relative to the inner sleeve after unfolded.

Preferably, the positioning device includes a positioning spring and a holding ball biased by the spring.

Preferably, the upper nest is secured to the upper end of the outer sleeve. A lower portion of the upper nest is fitted on the outer sleeve and formed with a groove corresponding in position to a notch of the outer sleeve.

Preferably, the transformation ratio rope and the inner sleeve pull rope are the same rope.

Preferably, a lower end of the upper nest is connected with a boost spring fitted on the outer sleeve.

Preferably, the push rod is composed of a pair of symmetrical hard rod members. Two sides of the inner sleeve plug are formed with guide grooves.

Preferably, the push rod is a hard pipe.

Preferably, the power source is a motor or a mechanical drive cooperating with a change gear set to drive the screw rod.

Accordingly, the middle rod set of the present invention is provided with the umbrella opening/closing control system composed of three pull ropes. The three pull ropes are connected with the sleeves of the middle rod set, the upper nest, and the lower nest respectively, and cooperate with the power source in the handle to drive the screw rod of the umbrella opening/closing operating system. When the nut on the screw rod is moved up and down, the push rod is pushed to bring the middle sleeve to move up and down relative to the inner sleeve to unfold/fold the sleeves of the middle rod set and the umbrella cloth. The multi-folding umbrella can be folded or unfolded automatically. The main rib is pivotally connected to the lower nest, and the sub-rib is pivotally connected to the upper nest, so that the outer surface of the umbrella cloth is folded in the umbrella and not exposed when the umbrella is folded. On a rainy day, the clothes of the user won't be wetted by rain on the umbrella cloth so that people use the umbrella more conveniently, comfortably, and quickly.

DETAILED DESCRIPTION OF THE PREFERRED EMBODIMENTS

Embodiments of the present invention will now be described, by way of example only, with reference to the accompanying drawings.

As shown in FIG. 1 to FIG. 4, the present invention disclosures an automatic reverse multi-folding umbrella. In an embodiment, a three-section folding umbrella is taken as an example. The umbrella comprises a frame A, a middle rod set B, an upper nest C, a lower nest D, an umbrella opening/closing control system E, an umbrella opening/closing operating system F, a handle G and an umbrella cloth H secured on the frame A.

Figure 1:
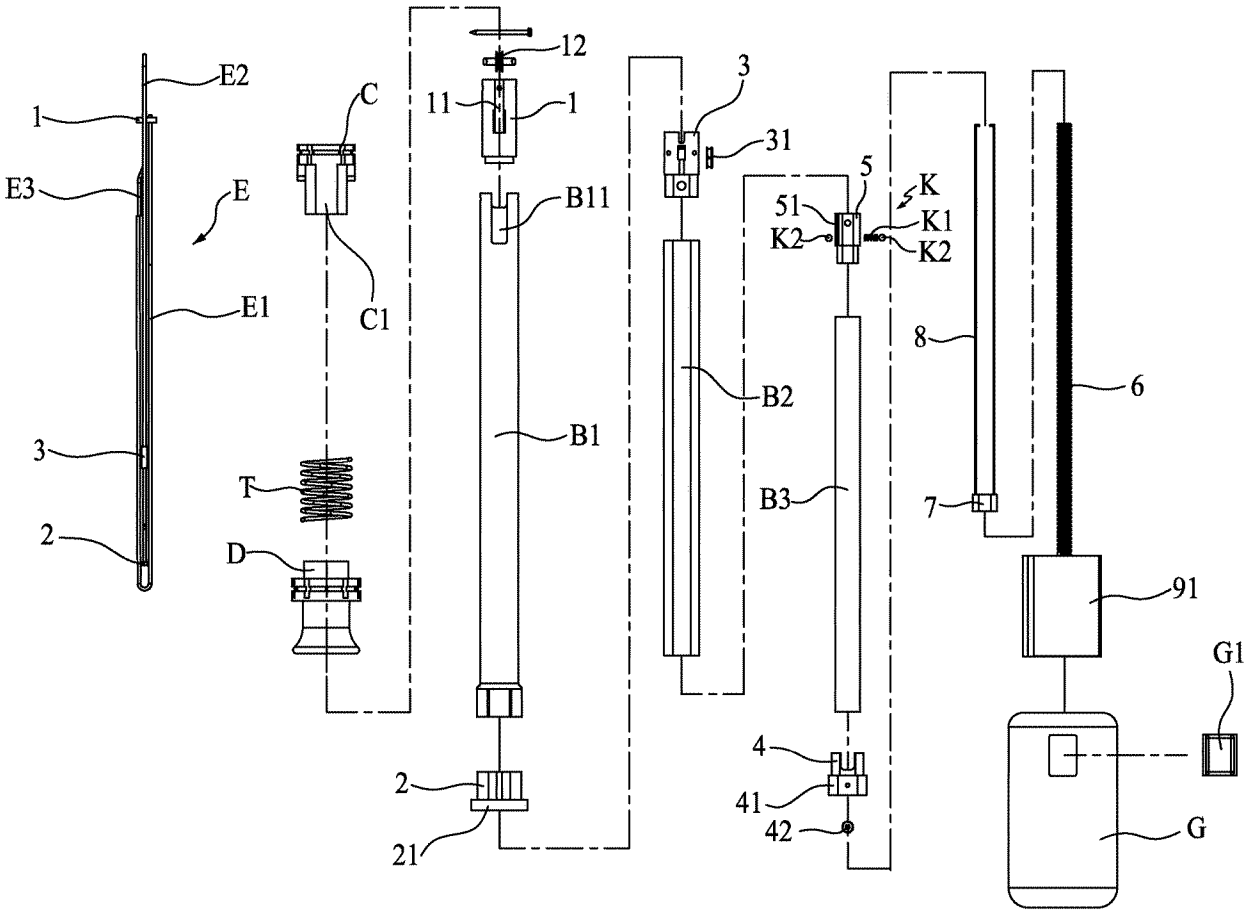
FIG. 1 is a partial exploded view of the umbrella of the present invention.
Figure 2:
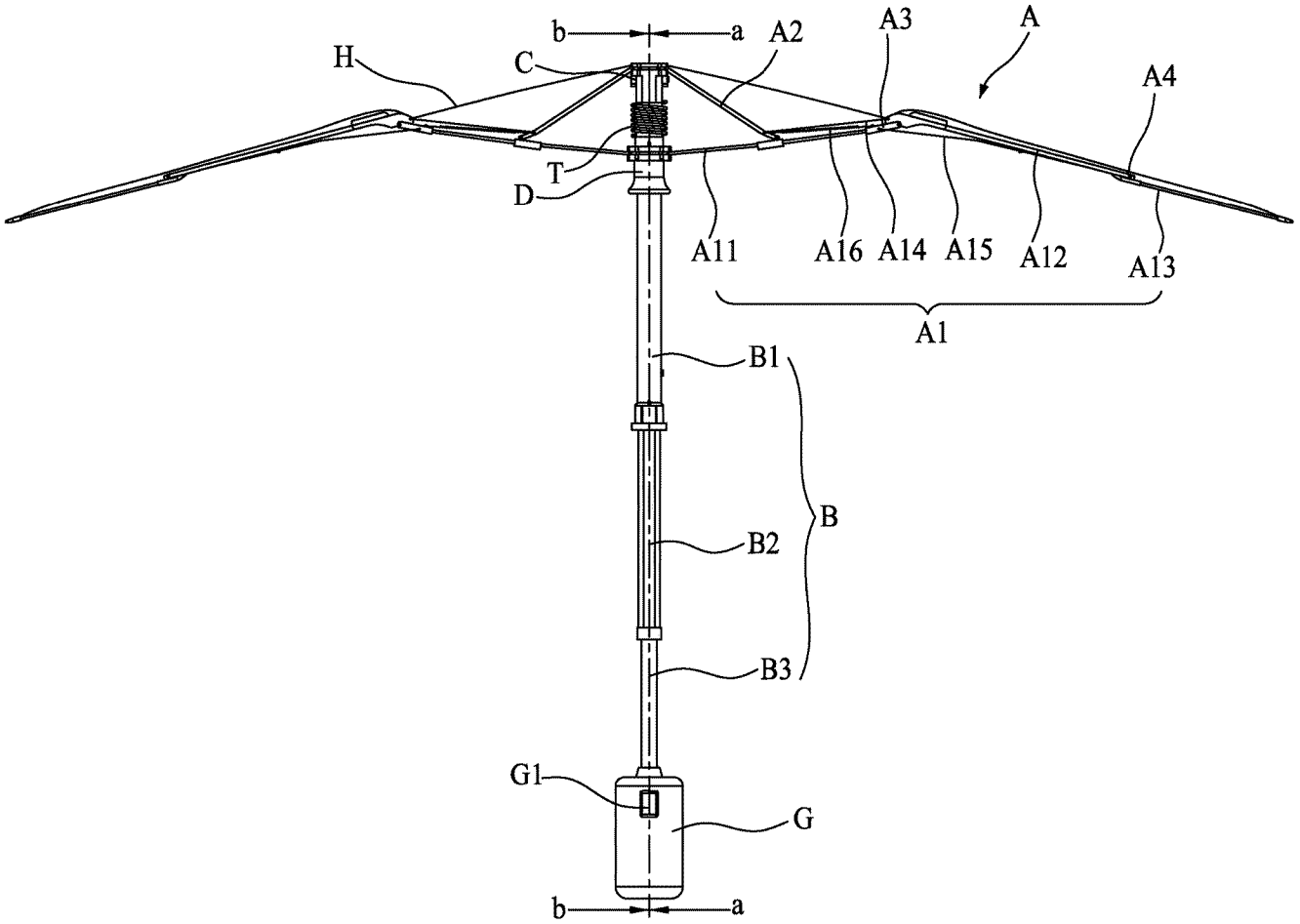
FIG. 2 is a schematic view showing the umbrella of the present invention in an unfolded state.
Figure 3:
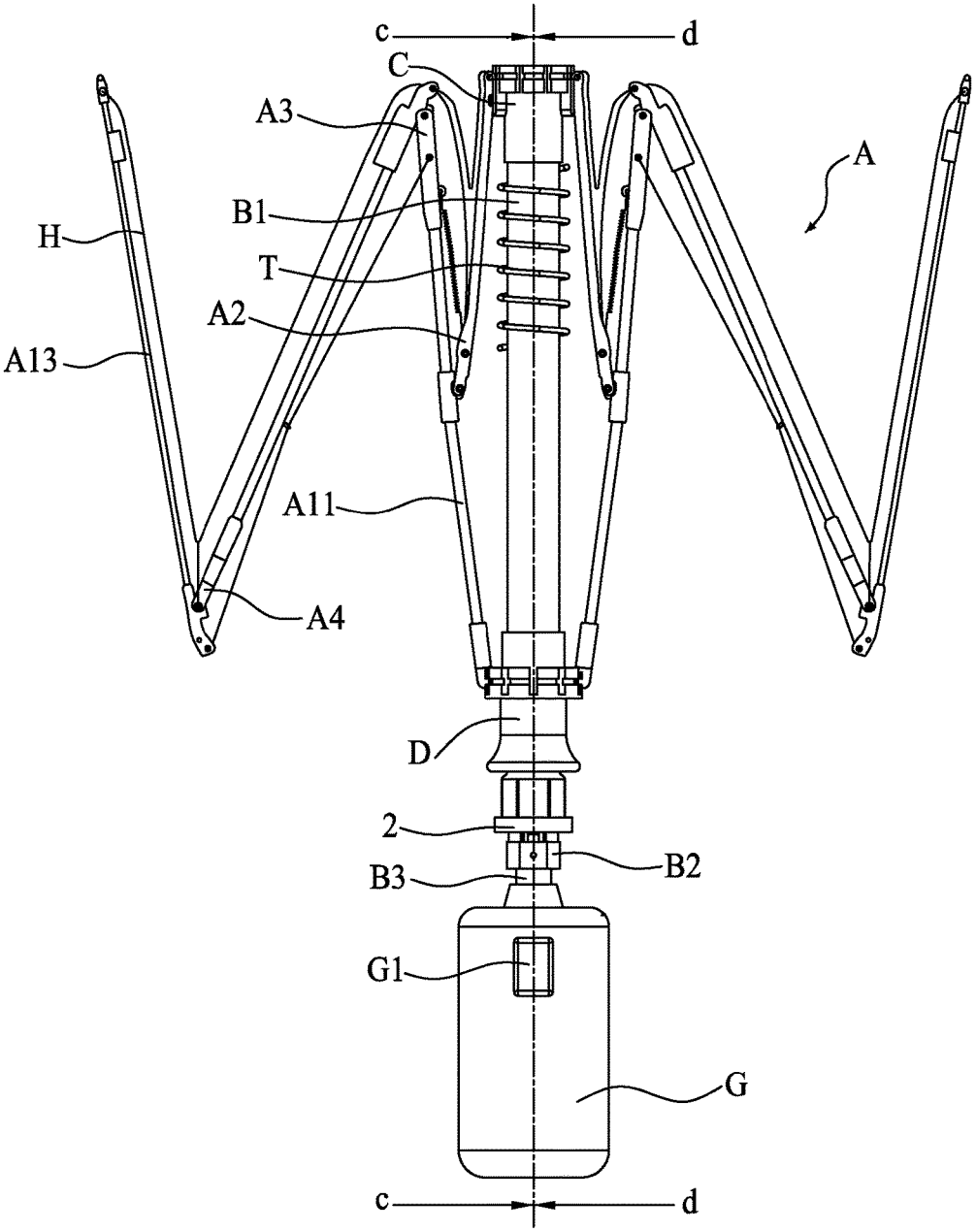
FIG. 3 is a schematic view showing the umbrella of the present invention in a folded state.

As shown in FIG. 2 and FIG. 3, the frame A includes a main rib A1 and a sub-rib A2. The main rib A1 includes an inner rib A11, an intermediate rib A12, an outer rib A13, an intermediate rib return line A14, an outer rib return line A15, and a spring A16. One end of the sub-rib A2 is pivotally connected to the upper nest C, and another end of the sub-rib A2 is pivotally connected to the inner rib A11. An inner end of the inner rib A11 is pivotally connected to the lower nest D which slide up and down along the umbrella the middle rod set B, and an outer end of the inner rib A11 is pivotally connected to the intermediate rib A12 through a first pivot joint A3. An outer end of the intermediate rib A12 is pivotally connected to the outer rib A13 through a second pivot joint A4, and an outer end of the outer rib A13 is connected to an outer edge of the umbrella cloth H through a bead. An inner edge of the umbrella cloth H is secured on the upper nest C. One end of the intermediate rib return line A14 is pivotally connected to the sub-rib A2, and another end of the intermediate rib return line A14 is pivotally connected to the first pivot joint A3 on a joint of the intermediate rib A12. One end of the spring A16 is connected to the sub-rib A2, and another end of the spring A16 is connected to the first pivot joint A3. One end of the outer rib return line A15 is pivotally connected to the first pivot joint A3, and another end of the outer rib return line A15 is pivotally connected to the outer rib 13. The middle section of the outer rib return line A15 is limited on the intermediate rib A12. That is, it is wound around or inserted through a retaining ring on the intermediate rib A12 to be limited thereon.

The middle rod set B has three sleeves, including an outer sleeve B1, a middle sleeve B2 and an inner sleeve B3 arranged from top to bottom in sequence.

An outer sleeve plug 1 is fixed inside an upper end of the outer sleeve B1, and an outer sleeve fixing ring 2 is fixed to a lower end of the outer sleeve B1. The outer sleeve plug 1 has a central through hole 11. An outer sleeve pulley 12 is provided at an upper part of the outer sleeve plug 1. The outer sleeve B1 is formed with a notch B11 corresponding in position to the outer sleeve pulley 12 for passing of a lower nest pull rope E1. The outer sleeve fixing ring 2 is an annular member. The upper part of the outer sleeve fixing ring 2 is inserted and secured in the outer sleeve B1, and the lower end of the outer sleeve fixing ring 2 is formed with a flange 21 protruding out of the outer sleeve B1.

A middle sleeve plug 3 is fixed to an upper end of the middle sleeve B2, and a middle sleeve fixing ring 4 is fixed to a lower end of the middle sleeve B2. The lower part of the middle sleeve plug 3 is inserted into the middle sleeve B2. The middle part of the middle sleeve plug 3 is provided with a middle sleeve pulley 31. The number of the middle sleeve pulley 31 may be one or more. In this embodiment, there is one middle sleeve pulley 31. The middle sleeve fixing ring 4 is an annular member. The upper part of the middle sleeve fixing ring 4 is inserted and secured in the middle sleeve B2, and the lower end of the middle sleeve fixing ring 4 is formed with a flange 41 protruding out of the middle sleeve B2. One side of the flange 41 is provided with a middle sleeve fixing ring pulley 42. The middle sleeve B2 is formed with a notch corresponding in position to the middle sleeve fixing ring pulley 42 for passing of a transformation ratio pull rope E2.

An inner sleeve plug 5 is fixed to an upper end of the inner sleeve B3, and a lower end of the inner sleeve B3 is fixed to the handle G. The inner sleeve B3 is radially provided with a positioning device K. The positioning device K includes a positioning spring K1 and a holding ball K2. The positioning device K is to apply a holding force to the inner wall of the middle sleeve B2 for preventing the middle sleeve B2 from sliding down relative to the inner sleeve B3 after unfolded.

The aforesaid three sleeves uses their respective plugs, namely, the middle sleeve plug 3 and the inner sleeve plug 5, to cooperate with their respective fixing rings, namely, the outer sleeve fixing ring 2 and the middle sleeve fixing ring 4, to connect with each other, such that the middle rod set B can be folded and unfolded. There is no need for additional parts for connection.

The upper nest C is secured to the top end of the outer sleeve B1. The lower part of the upper nest C is fitted on the outer sleeve B1, and is formed with a groove C1 corresponding in position to the notch B11 of the outer sleeve B1 for passing of the lower nest pull rope E1. The lower end of the upper nest C is connected with a boost spring T. The boost spring T is compressed by the lower nest D to store energy when the umbrella is in an open state. The lower nest D is a slidably fitted on the outer sleeve B1.

The umbrella opening/closing control system E includes a lower nest pull rope E1, a transmission ratio pull rope E2, and an inner sleeve pull rope E3.

One end of the lower nest pull rope E1 is fixed to the top of the middle sleeve plug 3, and another end of the lower nest pull rope E1 is inserted through the outer sleeve B1 and wound on the outer sleeve pulley 12 of the outer sleeve plug 1 to be fixed to the lower nest D.

One end of the transformation ratio pull rope E2 is fixed to the upper end of the inner sleeve B3. In this embodiment, it is fixed on the inner sleeve plug 5. Another end of the transformation ratio pull rope E2 is inserted through the notch B21 at the bottom of the middle sleeve B2, and wound on the middle sleeve fixing ring pulley 42 of the middle sleeve fixing ring 4, and inserted through the middle sleeve B2 to extend out of the upper end of the middle sleeve B2, and inserted through the outer sleeve B1 to extend out of the upper end of the outer sleeve B1 to be fixed on the outer sleeve plug 1.

One end of the inner sleeve pull rope E3 is fixed to the upper end of the inner sleeve B3. In this embodiment, it is fixed on the inner sleeve plug 5. Another end of the inner sleeve pull rope E3 is inserted through the middle sleeve B2, and wound on the middle sleeve pulley 31 of the middle sleeve plug 3 to extend out of the middle sleeve B2, and inserted between the middle sleeve B2 and the outer sleeve B1 to be fixed to the lower end of the outer sleeve B1. In this embodiment, it is fixed to the flange 21 of the outer sleeve fixing ring 2.

Because one end of the transmission ratio pull rope E2 and one end of the inner sleeve pull rope E3 are fixed to the upper end of the inner sleeve B3, the transmission ratio pull rope E2 and the inner sleeve pull rope E3 can be the same rope.

The umbrella opening/closing operating system F includes a screw rod 6, a nut 7 mated on the screw rod 6, a push rod 8 connected with the nut 7, and a power source 9 to drive the screw rod 6. The power source 9 is disposed in the handle G, which is a motor to bring a gear set to connect the screw rod 6, alternatively, uses a mechanical drive cooperating with a change gear set to drive the screw rod 6. Certainly, it can be the rotation axle of the motor to cooperate with the screw rod 6 directly.

The lower end of the push rod 8 cooperates with the nut 7. The upper end of the push rod 8 passes through the inner sleeve plug 5 and is connected on the middle sleeve plug 3. In this embodiment, the push rod 8 is composed of a pair of symmetrical hard rod members, such as steel wires. Alternatively, the push rod 8 can be a hard pipe. Through the push rod 8, the nut 7 can bring the middle sleeve plug 3 to move up and down.

The upper end of the screw rod 6 cooperates with the inner sleeve plug 5. The inner sleeve plug 5 is formed with a guide groove 51 for passing of the push rod 8. In this embodiment, two sides of the inner sleeve plug 5 are formed with guide grooves 8 to accommodate the push rod 8.

The handle G is a cover to accommodate the power source 9. The handle G is provided with a button G1 to switch on the clockwise/counterclockwise turning power of the power source 9.

Figure 3A:
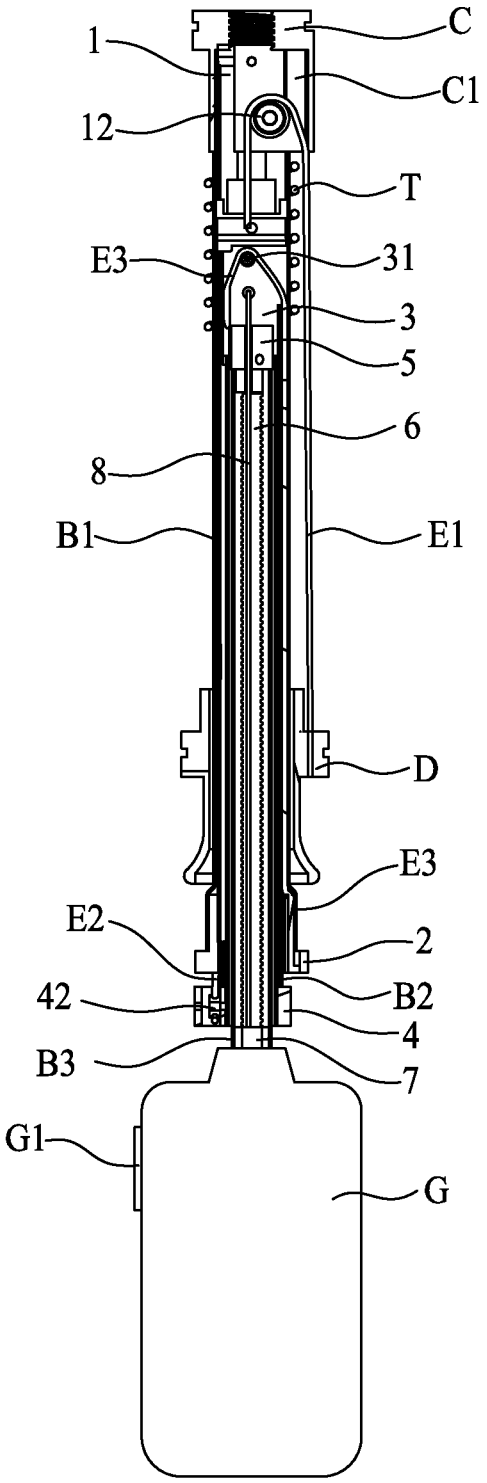
FIG. 3*a* is a sectional view taken along line c-c of FIG. 3.
Figure 3B:
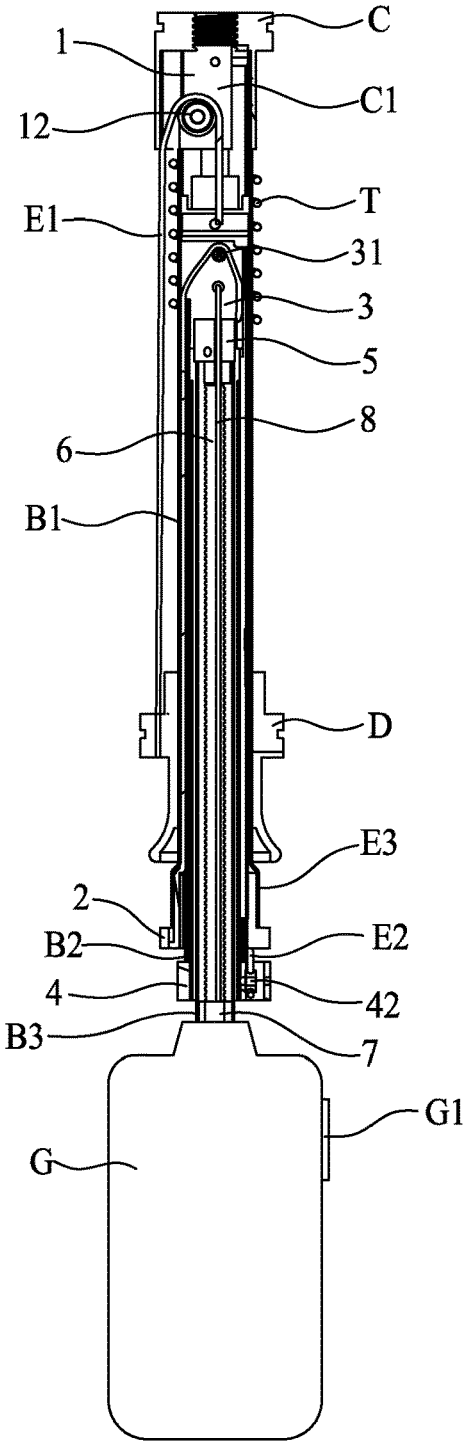
FIG. 3*b* is a sectional view taken along line d-d of FIG. 3.
Figure 4:
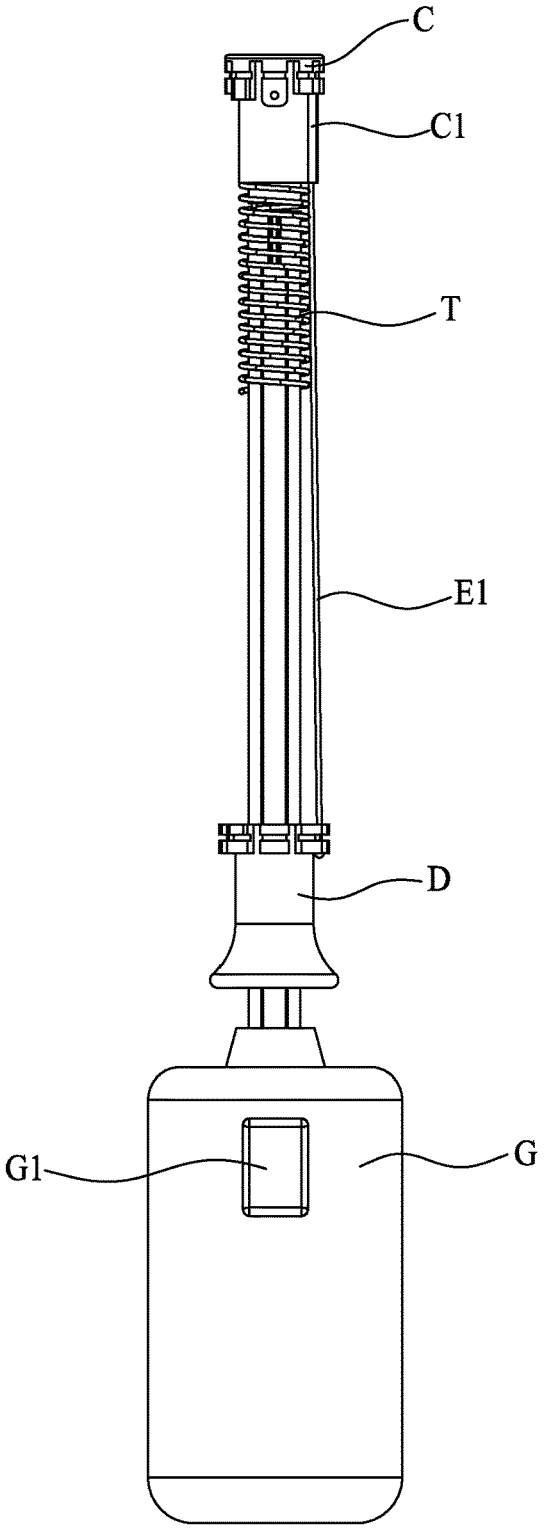
FIG. 4 is a partial schematic view showing the umbrella of the present invention in a folded state.

As shown in FIGS. 3, 3*a*, 3*b*, when the automatic reverse multi-folding umbrella is folded, the sleeved of the middle rod set B are retraced, the nut 7 is located at the lower portion of the screw rod 6, and the lower nest D is located at the lower portion of the outer sleeve B2. The umbrella cloth H is folded between the outer rib A13 and the intermediate rib A12 and between the inner rib A11 and the sub-rib A2. The outer surface of the umbrella cloth H is not exposed.

Figure 2A:
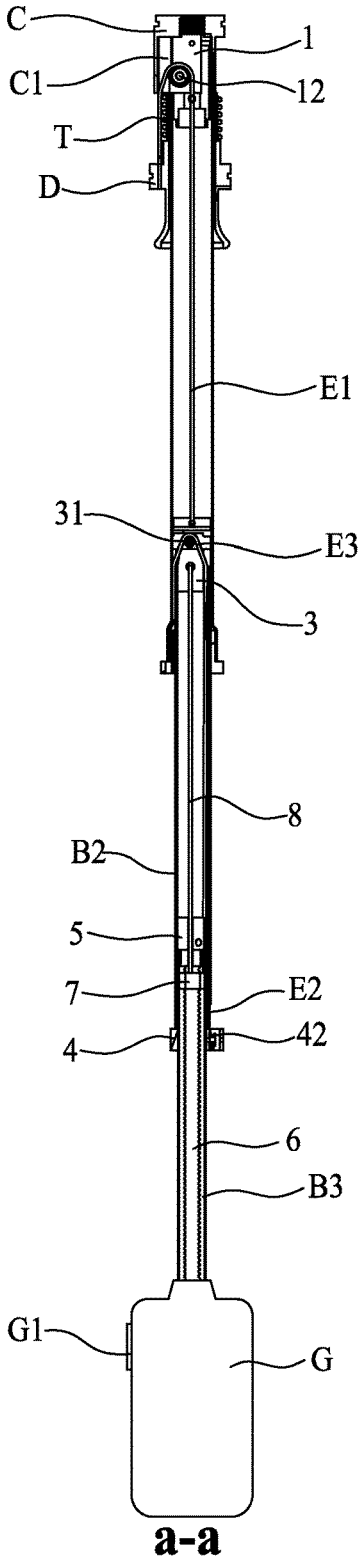
FIG. 2*a* is a sectional view taken along line a-a of FIG. 2.
Figure 2B:
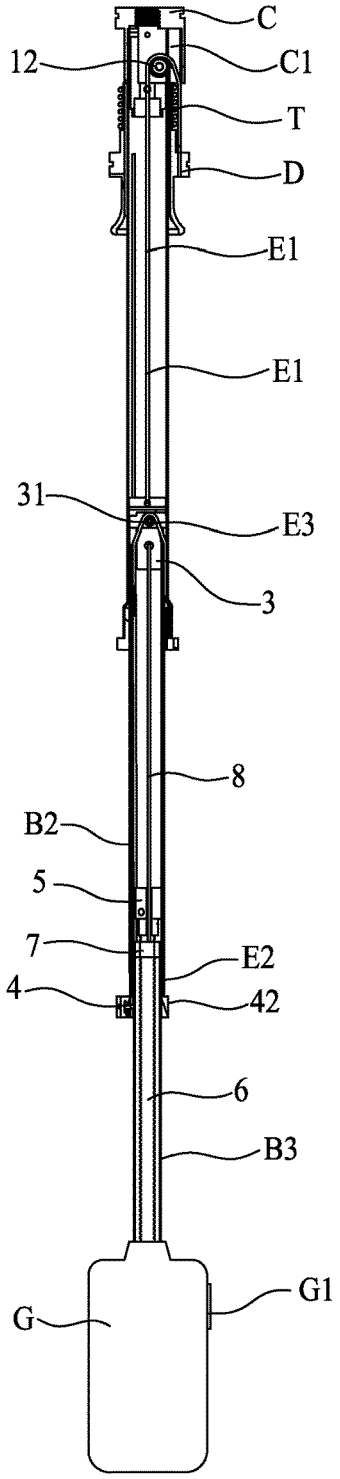
FIG. 2*b* is a sectional view taken along line b-b of FIG. 2.

As shown in FIG. 2, FIG. 2*a*, FIG. 2*b*, when the user wants to unfold the umbrella, the button G1 of the handle G is pressed to start the power source 9 to output a power to turn clockwise. The power source 9 will drive the screw rod 6 to turn, and the nut 7 will be moved upward along the screw rod 6. When the nut 7 is moved upward, the screw rod 6 will use the push rod 8 to push the middle sleeve plug 3 to move the middle sleeve B2 upward. The middle sleeve B2 is pushed to unfold upward relative to the inner sleeve B3. When the middle sleeve B2 is moved upward, the distance between the middle sleeve plug 3 and the upper end of the inner sleeve B3 is lengthened. The inner sleeve pull rope E3 will pull the outer sleeve fixing ring 2 to move upward relative to the middle sleeve B2 to compensate the change of the distance, that is, the outer sleeve B1 is pushed to unfold relative to the middle sleeve B2. At this moment, the distance between the outer sleeve plug 1 and the middle sleeve plug 3 is lengthened. The lower nest pull rope E1 will pull the lower nest D to move upward relative to the outer sleeve B1 to compensate the change of the distance. The lower nest D is moved upward, so that the angle between the inner rib A11 and the sub-rib A2 becomes smaller. The intermediate rib return line A14 enables the first joint A3 on the joint of the intermediate rib A12 to apply a force opposite the direction of the middle rod set B, so that the intermediate rib A12 is unfolded and the outer rib A13 is also unfolded. The umbrella cloth H is unfolded along with the outer rib A13, the intermediate rib A12, the inner rib A11, and the sub-rib A2. In this way, the umbrella is fully unfolded. Subject to positioning device K of the inner sleeve plug 5, the middle sleeve won't slide down relative to the inner sleeve. During the operation to unfold the umbrella, the inner sleeve pull rope E3 and the lower nest pull rope E1 are mainly to unfold the umbrella. The transformation ratio pull rope E2 is for the change of the shortened distance between the middle sleeve fixing ring 4 and the inner sleeve B3 and for the change of the lengthened distance between the outer sleeve plug 1 and the upper end of the inner sleeve B3.

As shown in FIG. 3, FIG. 3*a*, FIG. 3*b*, when the user wants to fold the umbrella, the button G1 of the handle G is pressed to start the power source 9 to output a power to turn reversely. The power source 9 will drive the screw rod 6 to turn reversely, and the nut 7 will be moved downward along the screw rod 6. When the nut 7 is moved downward, the screw rod 6 will use the push rod 8 to bring the middle sleeve plug 3, and the nut 7 will bring the screw rod 6 to move downward relative to the inner sleeve B3 so as to pull the middle sleeve B2 to move downward relative to the inner sleeve B3. At the same time, the lower nest D biased by the boost spring T will be moved downward along the outer sleeve B1. The distance between the middle sleeve fixing ring 4 and the upper end of the inner sleeve B3 is lengthened while the middle sleeve B2 is moved downward. The transformation ratio pull rope E2 will pull the outer sleeve plug 1 to bring the outer sleeve B1 to move downward relative to the middle sleeve B2. The lower nest pull rope E1 connected on the middle sleeve plug 3 will release the lower nest D, and the lower nest D will move downward along the outer sleeve B1 to move the inner rib A11 downward. The intermediate rib return line A14 enables the first joint A3 on the joint of the intermediate rib A12 to apply a force toward the direction of the middle rod set B, so that the intermediate rib A12 is folded inward and the outer rib A13 is also folded inward. The umbrella cloth H is folded reversely along with the outer rib A13, the intermediate rib A12, the inner rib A11, and the sub-rib A2. In this way, the umbrella is fully unfolded. The outer surface of the umbrella cloth H is not exposed. During the operation to fold the umbrella, the transformation ratio pull rope E2 and the lower nest pull rope E1 are mainly to fold the umbrella. The inner sleeve pull rope E3 is for the change of the lengthened distance between the outer sleeve fixing ring 2 and the middle sleeve plug 3 and for the change of the shortened distance between the middle sleeve plug 3 and the upper end of the inner sleeve B3.

Accordingly, the middle rod set B of the present invention is provided with the umbrella opening/closing control system E composed of three pull ropes. The three pull ropes are connected with the sleeves of the middle rod set B, the upper nest C, and the lower nest D, respectively, and cooperate with the power source 9 in the handle G to drive the screw rod 6 of the umbrella opening/closing operating system F. When the nut 7 on the screw rod 6 is moved up and down, the push rod 8 is pushed to bring the middle sleeve B2 to move up and down relative to the inner sleeve B3 to unfold/fold the sleeves of the middle rod set B and the umbrella cloth. The multi-folding umbrella can be folded or unfolded automatically. The main rib A1 is pivotally connected to the lower nest D, and the sub-rib A2 is pivotally connected to the upper nest C, so that the outer surface of the umbrella cloth H is folded in the umbrella and not exposed when the umbrella is folded. On a rainy day, the clothes of the user won't be wetted by rain on the umbrella cloth so that people use the umbrella more conveniently, comfortably, and quickly.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An automatic reverse multi-folding umbrella, comprising a frame, an umbrella cloth secured on the frame, a middle rod set, an upper nest fixed to an upper end of the middle rod set, a lower nest fitted on the middle rod set, a handle, an umbrella opening/closing control system disposed in the middle rod set, and an umbrella opening/closing operating system disposed in the handle and the middle rod set;

the frame including a main rib and a sub-rib, the main rib including an inner rib, an intermediate rib, an outer rib, an intermediate rib return line, an outer rib return line, and a spring; one end of the sub-rib being pivotally connected to the upper nest, another end of the sub-rib being pivotally connected to the inner rib; an inner end of the inner rib being pivotally connected to the lower nest, an outer end of the inner rib being pivotally connected to the intermediate rib through a first pivot joint; an outer end of the intermediate rib being pivotally connected to the outer rib through a second pivot joint; an outer end of the outer rib being connected to an outer edge of the umbrella cloth through a bead, an inner edge of the umbrella cloth being secured on the upper nest; one end of the intermediate rib return line being pivotally connected to the sub-rib, another end of the intermediate rib return line being pivotally connected to the first pivot joint on a joint of the intermediate rib; one end of the spring being connected to the sub-rib, another end of the spring being connected to the first pivot joint; one end of the outer rib return line being pivotally connected to the first pivot joint, another end of the outer rib return line being pivotally connected to the outer rib;

the middle rod set having at least three sleeves which are an outer sleeve, a middle sleeve and an inner sleeve arranged from top to bottom in sequence; an upper end of the outer sleeve being provided with an outer sleeve pulley, a lower end of the outer sleeve being connected with an outer sleeve fixing ring cooperating with the middle sleeve; an upper end of the middle sleeve being provided with a middle sleeve plug having a middle sleeve pulley, a lower end of the middle sleeve being connected with a middle sleeve fixing ring, an outer side of the middle sleeve fixing ring being provided with a middle sleeve fixing ring pulley; a lower end of the inner sleeve being fixed to the handle;

the umbrella opening/closing control system including a lower nest pull rope, a transformation ratio pull rope, and an inner sleeve pull rope; one end of the lower nest pull rope being fixed to the middle sleeve plug, another end of the lower nest pull rope being inserted through the outer sleeve and wound on the outer sleeve pulley to be fixed to the lower nest; one end of the transformation ratio pull rope being fixed to the upper end of the inner sleeve, another end of the transformation ratio pull rope being inserted through a bottom of the middle sleeve and wound on the middle sleeve fixing ring pulley of the middle sleeve fixing ring and inserted through the middle sleeve to extend out of the upper end of the middle sleeve and inserted through the outer sleeve to extend out of the upper end of the outer sleeve to be fixed to a top of the outer sleeve; one end of the inner sleeve pull rope being fixed to the upper end of the inner sleeve, another end of the inner sleeve pull rope being inserted through the middle sleeve and wound on the middle sleeve pulley of the middle sleeve plug and inserted between the middle sleeve and the outer sleeve to be fixed to the lower end of the outer sleeve;

the umbrella opening/closing operating system including a screw rod, a nut mated on the screw rod, a push rod connected with the nut, and a power source to drive the screw rod; another end of the push rod being connected to the middle sleeve plug, the power source being controlled by a button on the handle.

2. The automatic reverse multi-folding umbrella as claimed in claim 1, wherein an outer sleeve plug is provided and fixed in the upper end of the outer sleeve, the outer sleeve plug has a central through hole, the outer sleeve pulley is disposed at an upper portion of the outer sleeve plug, and the outer sleeve is formed with a notch corresponding in position to the outer sleeve pulley.

3. The automatic reverse multi-folding umbrella as claimed in claim 1, wherein an inner sleeve plug is provided and fixed to an upper end of the inner sleeve, and the inner sleeve is radially provided with a positioning device for preventing the middle sleeve from sliding down relative to the inner sleeve after unfolded.

4. The automatic reverse multi-folding umbrella as claimed in claim 3, wherein the positioning device includes a positioning spring and a holding ball biased by the spring.

5. The automatic reverse multi-folding umbrella as claimed in claim 1, wherein the upper nest is secured to the upper end of the outer sleeve, and a lower portion of the upper nest is fitted on the outer sleeve and formed with a groove corresponding in position to a notch of the outer sleeve.

6. The automatic reverse multi-folding umbrella as claimed in claim 1, wherein a lower end of the upper nest is connected with a boost spring fitted on the outer sleeve.

7. The automatic reverse multi-folding umbrella as claimed in claim 1, wherein the push rod is composed of a pair of symmetrical hard rod members, and two sides of the inner sleeve plug are formed with guide grooves.

8. The automatic reverse multi-folding umbrella as claimed in claim 1, wherein the push rod is a hard pipe.

9. The automatic reverse multi-folding umbrella as claimed in claim 1, wherein the power source is a motor or a mechanical drive cooperating with a change gear set to drive the screw rod.

* * * * *